US005361931A

United States Patent [19]

VanLandingham

[11] Patent Number: 5,361,931

[45] Date of Patent: Nov. 8, 1994

[54] OIL DRAIN LINE DRIP RECEPTACLE

[76] Inventor: Michael F. VanLandingham, 15701 78th St., Lexington, Okla. 73501

[21] Appl. No.: 103,470

[22] Filed: Aug. 9, 1993

Related U.S. Application Data

[63] Continuation-in-part of Ser. No. 878,070, May 4, 1992, abandoned.

[51] Int. Cl.[5] ..... B65D 90/24

[52] U.S. Cl. ..... 220/571; 141/86; 220/86.1; 220/DIG. 6; 405/52

[58] Field of Search ..... 405/52, 303; 137/312, 137/313; 141/86, 87, 88; 222/108; 220/571

[56] References Cited

U.S. PATENT DOCUMENTS

| | | | |
|---|---|---|---|
| 4,082,125 | 4/1978 | Wilson et al. | 141/86 |
| 4,659,251 | 4/1987 | Petter et al. | 405/52 |
| 4,802,514 | 2/1989 | Morse | 137/312 X |
| 4,842,443 | 6/1989 | Argandona | 405/52 |
| 5,071,166 | 12/1991 | Marino | 220/571 X |
| 5,101,869 | 4/1992 | Myers | 141/86 X |
| 5,165,574 | 11/1992 | Ratcliffe | 222/108 |
| 5,186,577 | 2/1993 | Reicin et al. | 405/52 |
| 5,189,919 | 3/1993 | Hernandez | 222/108 X |
| 5,197,627 | 3/1993 | Disabato et al. | 220/571 |
| 5,203,386 | 4/1993 | Harp | 141/86 |
| 5,230,372 | 7/1993 | Westphal | 141/86 |
| 5,246,044 | 9/1993 | Robertson | 141/86 |

FOREIGN PATENT DOCUMENTS

| | | | |
|---|---|---|---|
| 2224781 | 1/1974 | Germany | 220/571 |

*Primary Examiner*—David H. Corbin
*Attorney, Agent, or Firm*—Robert K. Rhea

[57] ABSTRACT

An oil field anti-pollution device is formed by a closed end tubular receptacle having a lid and connected by one end wall with the fluid outlet port of a gate valve on the end of an above ground storage tank horizontal drain line remote from the storage tank.

9 Claims, 2 Drawing Sheets

OIL DRAIN LINE DRIP RECEPTACLE

This invention is a Continuation-In-Part of an application filed by me in the United States Patent and Trademark Office on May 4, 1992 under Ser. No. 07/878,070 for Oil Drain Line Drip Receptacle, now abandoned.

BACKGROUND OF THE INVENTION

1. Field of the Invention

This invention relates to crude oil storage and more particularly to a receptacle for crude oil draining from the opening of a gate valve on the end of a storage tank horizontal drain line.

In isolated oil well producing sites, the crude oil is temporarily stored in a large capacity tank and periodically drained by a tank truck accessing the oil at a valve remote from the tank on the end of a tank drain line.

The tank truck is provided with a suction pump and hose which is connected with the horizontally disposed fluid passageway outlet port of a gate valve and after filling the truck tank, a relatively small amount of oil drips into the soil from the outlet port of the closed gate valve.

This invention provides a drip pan or receptacle for catching this relatively small amount of oil.

2. Description of the Prior Art

Prior patents generally relate to receptacles mounted on the hull of a boat for receiving fuel, exhausted through the fuel tank vent or to basin-like receptacles surrounding the top open end portion of a container or tank filler pipe.

U.S. Pat. No. 4,082,125, issued Apr. 4, 1978, to Wilson for Spillage Collection Device for Fuel Tanks for Boats and U.S. Pat. No. 4,842,443, issued Jun. 27, 1989, to Argandona for Spill Containment Device are considered state-of-the-art examples.

U.S. Pat. No. 4,082,125 discloses a fuel vent spillage receptacle in which an upwardly open receptacle is secured to the outer surface of a boat adjacent it's fuel vent for receiving liquid draining therefrom.

U.S. Pat. No. 4,842,443 discloses a below ground upwardly open spill containment device which is sealed around the filler pipe opening of an underground tank. A spill container surrounding and sealed with the pipe is provided with a port which drains fuel, by gravity, spilling into the container to the tank filler pipe.

This invention is believed distinctive over these and other prior art patents by connecting an upwardly open lid closed horizontally disposed tubular container with the outlet port of a fluid drain line valve.

SUMMARY OF THE INVENTION

A horizontally disposed closed end tubular receptacle of selected length and diameter is substantially diametrically divided longitudinally to define a bottom fluid container portion and a top lid portion, lockably hingedly connected with the bottom portion.

One bottom portion end wall is rigidly connected with a pipe fitting connecting the fluid container with the outlet port of a gate valve closing the discharge end of a storage tank horizontal drain line or pipe. The container end of the fitting cooperatively receives the intake end of a tank truck loading hose.

The principal object of this invention is to provide a soil pollution prevention device for the outlet end of an oil storage tank drain pipe.

DESCRIPTION OF THE PREFERRED EMBODIMENTS

Figure 1:
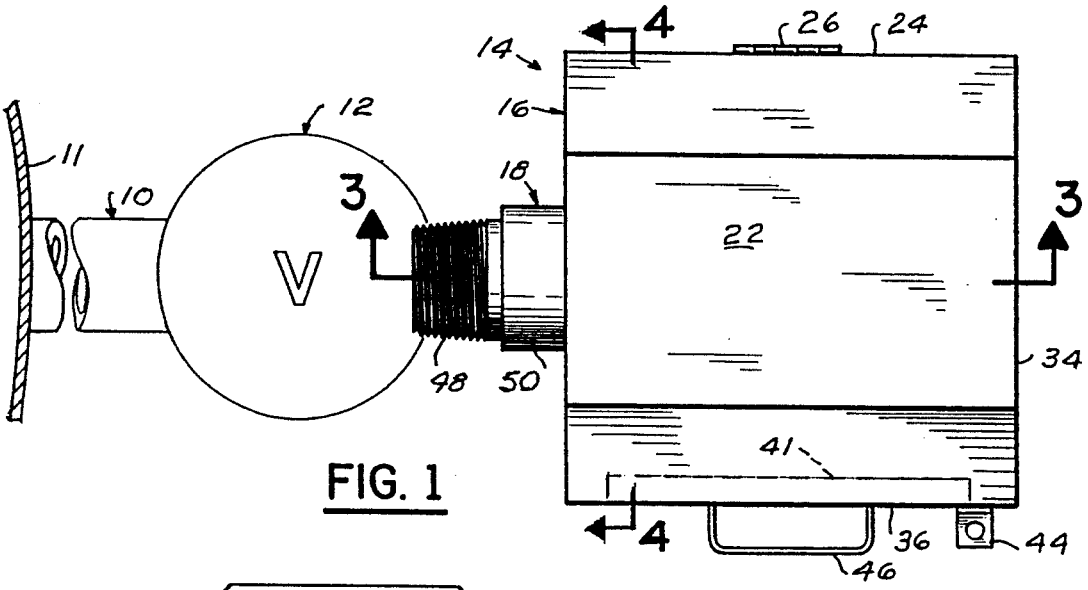
FIG. 1 is a top view of the device connected with a fragment of an oil storage tank drain pipe.

Like characters of reference designate like parts in those figures of the drawings in which they occur.

In the drawings:

The reference numeral 10 indicates the outlet end portion of a horizontally disposed crude oil tank drain line or pipe connected, at its other end, with a crude oil storage tank 11 and equipped with a shutoff valve 12.

The numeral 14 indicates a receptacle as a whole comprising a closed end tubular member 16 connected at one end with the outlet port of the gate valve 12 by a pipe fitting such as a bell nipple 18.

Figure 2:
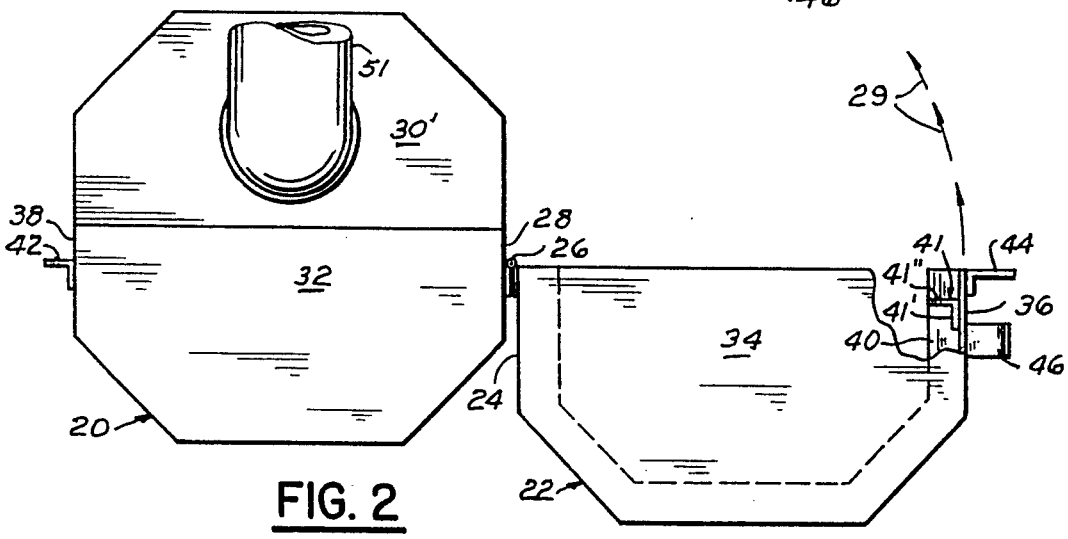
FIG. 2 is a right end elevational view of the device, connected with a fragment of a tank truck hose, with the lid in open position.

The receptacle 14 is substantially octagonal in end elevation (FIG. 2) and is substantially diametrically divided longitudinally to form a bottom section or fluid container 20 and a top section or lid 22 hingedly connected by one side wall 24, as at 26, with a cooperating side wall 28 of the container 20 for pivoting movement of the lid 22 toward and away from the container in the direction of the arrows 29.

Figure 3:
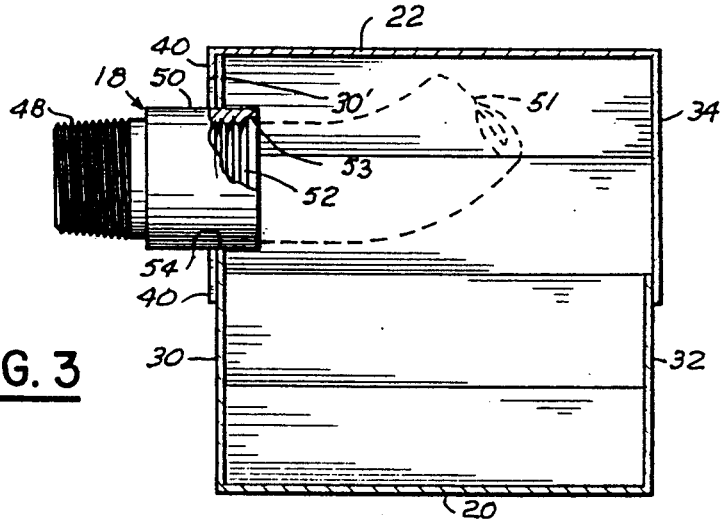
FIG. 3 is a vertical cross sectional view taken substantially along the line 3—3 of FIG. 1 with parts broken away for clarity and illustrating, by dash lines, the relative position of a tank truck hose.
Figure 5:
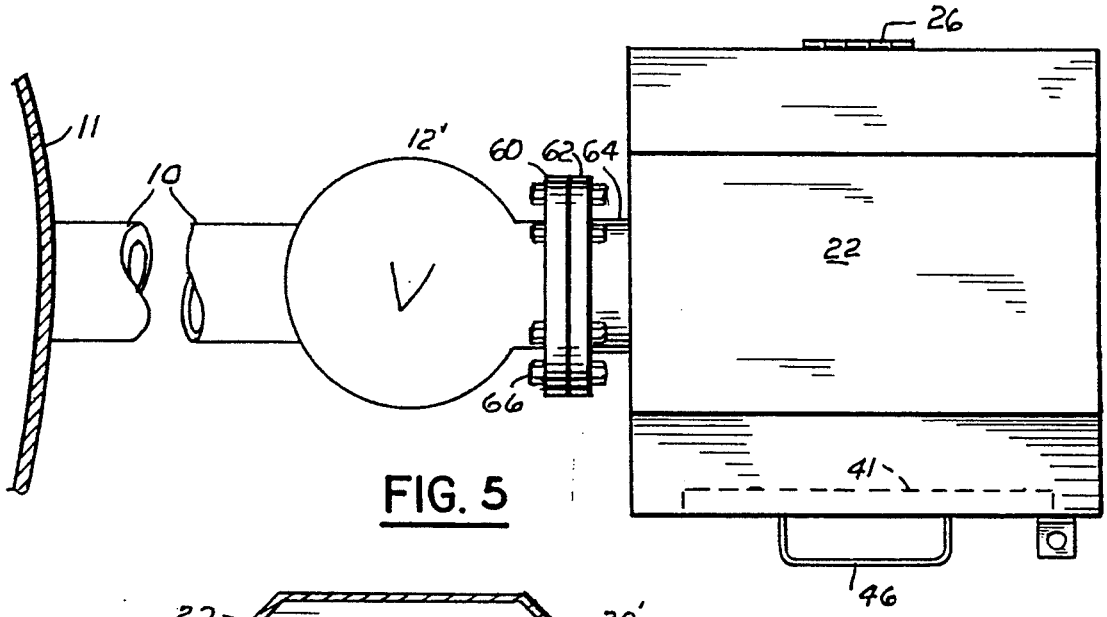
Figure 4:
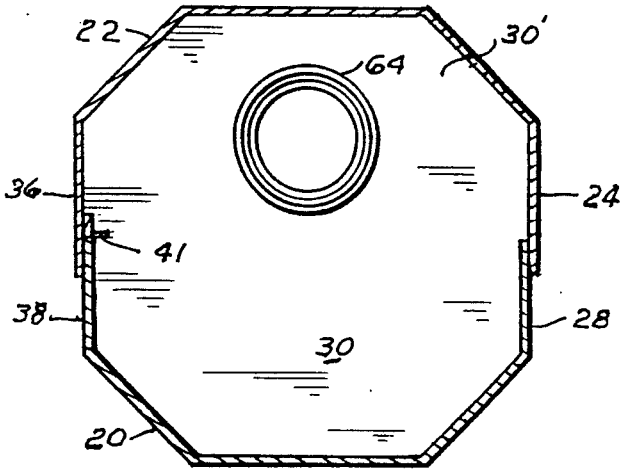
FIG. 4 is a vertical cross sectional view taken substantially along the line 4—4 of FIG. 1; and, FIG. 5 is a view similar to FIG. 1 illustrating an alternative embodiment of the pipe fitting.

An end wall 30 integral at its depending edges with the container 20, as viewed in FIGS. 3 and 5, projects upwardly to form an upper section 30' which cooperatively closes the end of the lid adjacent the valve 12 when the lid is disposed in closed position (FIG. 4).

A container end wall 32 closes its other end and similarly a companion upper end wall 34 is integral with the end of the lid 22 opposite the valve 12. The depending marginal edge of the lid end wall 34 outwardly overlaps the upper marginal edge of the container end wall 32 when the lid is in closed position (FIG. 3).

Similarly, the depending marginal edge of the lid side wall 24 overlies the upper marginal edge portion of the container side wall 28 while the depending marginal edge portion of the lid opposite side wall 36 overlies the upper marginal edge portion of the container side wall 38 to prevent rain, snow or other moisture from entering the receptacle 16 when the lid is in closed position.

The end edge of the lid adjacent the valve 12 is provided with an inwardly projecting flange 40 which similarly outwardly overlaps the outer surface of the upper marginal edges of the end wall upper portion 30' to similarly prevent moisture entering the receptacle.

Downward movement of the lid, when in a closed position, beyond the marginal edge overlapping dimension is prevented by an elongated right angular stop 41 having one leg 41' flatly secured to the inner surface of the lid side wall 36 in position to dispose its other leg 41'' normal to the adjacent surface of the side wall 36 and flatly abutting the upper edge surface of the container side wall 38.

The receptacle is provided with a lid locking means formed by a pair of right angular members 42 and 44 each having one leg respectively rigidly secured to the outer surface of the container side wall 38 and the lid side wall 36. The other legs of the members 42 and 44 are disposed in superposed relation vertically line drilled, as at 45 (FIG. 1), for receiving the U-bolt of a lock, not shown.

A handle 46 is secured to the lid side wall 36 for opening and closing the lid.

The bell nipple 18 has a smaller end portion provided with external threads 48 which are cooperatively received by the fluid outlet port of the valve 12. The other end portion 50 of the bell nipple is diametrically enlarged and provided with internal threads 52. The nipple end portion 50 is counterbored to form a rabbited-like edge or "bell" slightly larger diametrically than the thread diameter which nests and guides the threaded end portion of a tank truck pickup hose 51 into the threads 52. The upper portion of the container end wall 30' is centrally bored, as at 54, and rigidly connected with the periphery of the bell nipple end portion 50 intermediate its ends.

The gate valve 12 may be a flanged end gate valve 12' having a pipe flange 60 at its outlet port position. In this event, a companion bolt flange 62 having a relatively short tube portion 50' is connected in a similar manner with the upper section 30' of the container end wall.

Bolts 66 secure the two flanges together in fluid tight relation to complete a fluid passageway from the valve 12' into the container 20.

Obviously the invention is susceptible to changes or alterations without defeating its practicability. Therefore, I do not wish to be confined to the preferred embodiment shown in the drawings and described herein.

I claim:

1. In a fluid storage tank having a substantially horizontal drain pipe and having a gate valve normally closing the end of the pipe remote from the tank, the improvement comprising:

receptacle means including walls having upper marginal edges defining a fluid container bottom portion having a wall section projecting upwardly above a plane formed by said upper marginal edges of the remaining bottom portion walls for collecting and storing fluid draining from said tank valve when the latter is in closed position;

means including a pipe fitting connected with the gate valve and projecting through the upwardly projecting wall section of the container bottom portion for forming a fluid passageway from the gate valve through the container upwardly projecting wall section above the plane of the upper marginal edges of the remaining bottom portion walls; and, a tank truck hose connected with the fitting.

2. The combination according to claim 1 in which the container is upwardly open and further including:

a lid normally closing the container.

3. The combination according to claim 2 in which the pipe fitting means includes:

a bell nipple.

4. In a fluid storage tank having an above ground substantially horizontal drain pipe and having a gate valve normally closing the end of the pipe remote from the tank, the improvement comprising:

receptacle means including walls having upper marginal edges forming a fluid container bottom portion having a wall section projecting upwardly above a plane formed by said upper marginal edges of the remaining bottom portion walls for collecting and storing fluid draining from said tank valve when the latter is in closed position; and, means including an internally threaded pipe fitting connected with the gate valve and extending through the upwardly projecting wall section of the container bottom portion for forming a fluid passageway between the gate valve and a tank truck hose above the plane of the upper marginal edges of the remaining bottom portion walls.

5. The combination according to claim 4 in which the container is upwardly open and further including:

a lid normally closing the container.

6. The combination according to claim 5 in which the pipe fitting means comprises:

a pipe flange.

7. A toxic fluid spill collector for the discharge end of a substantially horizontally disposed above ground storage tank drain pipe having a valve adjacent its discharge end, comprising:

receptacle means including walls having upper marginal edges forming an upwardly open fluid container bottom portion having a wall section projecting upwardly above a plane formed by said upper marginal edges of the remaining bottom portion walls;

means including a pipe fitting extending from the valve through the container upwardly projecting wall section above the plane of the upper marginal edges of the remaining bottom portion walls for connecting the horizontal drain pipe with a tank truck hose; and, a lid connected with said container bottom portion for normally closing the container.

8. The combination according to claim 7 in which the pipe fitting means includes:

a threaded pipe nipple.

9. The combination according to claim 7 in which the pipe fitting means comprises:

a pipe flange.

* * * * *